US005188233A

United States Patent [19]

Hammett

[11] Patent Number: 5,188,233

[45] Date of Patent: Feb. 23, 1993

[54] BEVERAGE CONTAINER CARRIER

[75] Inventor: Roy Hammett, Tampa, Fla.

[73] Assignee: International Container Systems, Inc., Tampa, Fla.

[21] Appl. No.: 573,936

[22] Filed: Aug. 27, 1990

[51] Int. Cl.[5] ..... B65D 65/00

[52] U.S. Cl. ..... 206/427; 206/203; 220/DIG. 15

[58] Field of Search ..... 206/203, 427, 518; 220/509, 516, 518, 519, DIG. 15, DIG. 2

[56] References Cited

U.S. PATENT DOCUMENTS

| | | | |
|---|---|---|---|
| 827,124 | 7/1906 | Speer | 206/247 X |
| 2,475,924 | 7/1949 | Suiter | 206/247 X |
| 3,219,233 | 11/1965 | Whiteford | 206/203 |
| 3,281,010 | 10/1966 | Moore et al. | 206/203 |
| 3,333,729 | 8/1967 | Rabb | 206/203 X |
| 3,390,801 | 7/1968 | Adomat | 220/516 |
| 3,791,549 | 2/1974 | Delbrouck et al. | 220/516 X |
| 4,040,517 | 8/1977 | Torokvei | 206/203 X |
| 4,548,320 | 10/1985 | Box | 206/427 X |
| 4,838,419 | 6/1989 | Weits et al. | 206/503 X |
| 4,896,774 | 1/1990 | Hammett et al. | 206/427 X |
| 4,896,774 | 1/1990 | Hammett et al. | 206/564 X |
| 4,928,841 | 5/1990 | Arthurs | 206/203 X |
| 5,031,774 | 7/1991 | Morris et al. | 206/564 X |

FOREIGN PATENT DOCUMENTS

| | | | |
|---|---|---|---|
| 2302250 | 9/1976 | France | 206/427 |
| 2451864 | 11/1980 | France | 206/427 |

*Primary Examiner*—Jimmy G. Foster
*Assistant Examiner*—Beth Anne Cicconi
*Attorney, Agent, or Firm*—Shea & Gould

[57] ABSTRACT

A carrier tray for deformable beverage containers prevents doming of the underside of beverage cans and abrasion of adjacent cans during transport. The base of the carrier includes upwardly projecting members (62, 63) which are taped to conform to the shape of the underside of the containers. An additional feature of the upwardly projecting members is the retention of the cans in a vertical position.

7 Claims, 3 Drawing Sheets

BEVERAGE CONTAINER CARRIER

FIELD OF THE INVENTION

The present invention is directed to a carrier for beverage containers and more particularly to a carrier designed to prevent doming of the underside of beverage containers transported by the carrier.

BACKGROUND OF THE INVENTION

Can and bottle-containing carriers have been known for a long time. Such carriers typically have compartments for individual beverage containers. Beverage container carrier manufacturers have not however addressed the problem of deformation of the underside (i.e., doming) of a beverage can which may render it unsalable because the subsequent leaning, denting or abrasion of adjacent cans by a domed can could destroy the domed can or its "neighbors." If such doming or denting results in the spilling of a beverage, all remaining cans under certain regulations could become unsalable, causing severe loss to merchants. Current beverage container carriers have not adequately addressed how to create a carrier which will prevent such doming.

Examples of such carriers include U.S. Pat. No. 2,314,198 (De Reamer) which discloses a device for use in packing cans. The device has upwardly projecting ribs on the bottom of each can socket which prevent either end of one can from shifting laterally to engage its neighbors and prevent denting due to the jarring action experienced by the filled container in transport or other handling. The De Reamer patent does not contemplate a feature which would prevent the doming of the undersides of cans.

U.S. Pat. No. 3,281,010 (Moore) shows an article carrying case in which the bottom section of each receptacle area has raised ridges which helps position the bottles in the cells and to strengthen the case, but not to prevent doming.

U.S. Pat. No. 4,040,517 (Torokvei) describes a stacking case with upwardly projecting support member for carrying a number of bottles in each section of the case. These support members center the bottle in the cell and provide support for the bottles.

U.S. Pat. No. 3,333,729 (Rabb) describes a bottle carrier with dividers in which the bottom side of each section extends upwardly creating a protrusion which fits under the similarly shaped underside of the bottom of the bottle stacked above it and houses the cap area of the stacked bottles below it. This patent also does not address "doming" prevention.

U.S. Pat. No. 3,283,947 (Cornelius) reveals improvements to a bottle carrier for transporting, handling and storing crowned-cap beverage bottles in a container molded from suitable plastic material such as high-density polyethylene. FIG. 5 shows each cell of the carrier having a "centrally upwardly offset, preferably circular portion 19 connected with the normal plane of the base wall by means of a reinforcing offset tapered generally annular flange 20." Like the Torokvei and Rabb patents, this patent does not address "doming" prevention.

U.S. Pat. No. 3,203,583 (Amberg) shows a tray for cups filled with drinks, in which the compartment portions have "upward protruding portions" 22 at the underside of each cup receiving socket. The purpose of such protruding portions is to "permit air passage" to underlying stacked drink cups and presumably to prevent excessive lateral movement of the cups.

U.S. Pat. No. 4,142,634 (Leff) is directed to a separator for supporting stacked layers of containers having a plastic section with a honeycombed pattern embossed on its top surface for rigidity. The separators include "interior portions" which centrally position spools of yarn 15, 16.

U.S. Pat. No. 4,095,693 (Killy) is directed to a carton for packaging various articles having "chimes" formed at one end of the carton. A series of ribs formed on one of the panels of the carton abut a portion of the chimes to protect the exterior of the carton "from becoming disfigured by the chimes of the multiple articles packaged within making circular indentations on the interior face and coming through to the exterior portion of the carton whenever several cartons are stacked on top of each other." This patent is directed to preventing deformation of the carrier and not preventing deformation or doming of the stored or carried article.

It is accordingly an object of the present invention to create a can-carrying carrier designed to prevent doming of the underside of cans.

Yet another object of the invention is to create a can-carrying carrier which will also prevent abrasion of the can or neighboring cans.

A further object of the invention is to construct a can-carrying carrier which will prevent denting of the can or neighboring cans.

An additional object of the invention is to impede leaning of a can against a neighboring can or against a carrier wall.

Still another object of the invention is to create a carrier of sufficient strength to carry a large number of cans without cracking, breaking, or deforming.

SUMMARY OF THE INVENTION

To achieve these and other objects of the invention which will become hereinafter apparent, applicant has developed a beverage container carrier comprising a base and four side walls perpendicular to and circumscribing the base. The carrier is constructed to hold beverage containers and prevent doming of the underside of such containers. The particular anti-doming features of such a carrier are upwardly projecting members on the carrier base which is divided into sections on which cans are placed above the projecting members. The invention will be better understood in conjunction with the DETAILED DESCRIPTION OF THE PREFERRED EMBODIMENT SECTION of which:

DETAILED DESCRIPTION OF THE PREFERRED EMBODIMENT

Figure 1:
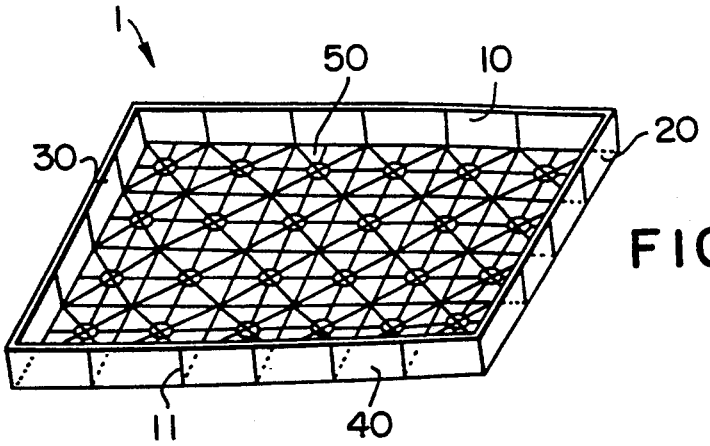
FIG. 1 is a perspective view of the beverage container carrier of the invention.
Figure 5:
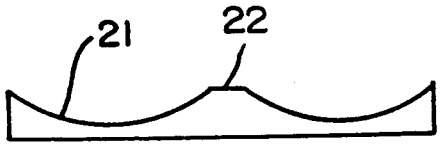
FIG. 5 is a plan view of a section of the upper part of the wall of the carrier.
Figure 6:
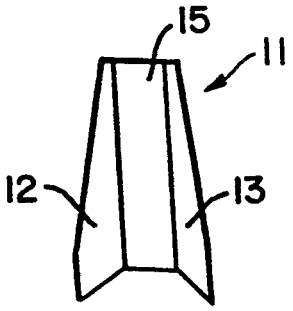
FIG. 6 is a perspective view of a stem of the carrier which extends from the base to the wall.

Referring now to the figures wherein like numerals represent like elements throughout the several views, FIG. 1 shows carrier 1 generally comprising base 50 circumscribed along its periphery by side walls 10, 20, 30 and 40. The side walls generally include a uniform series of upwardly projecting stems 11 extending from base 50 to each wall 10, 20, 30 and 40. Each stem 11 comprise three segments, including extreme segments 12, 13 which are shaped in a curved fashion to conform to the shape of the containers which are to be transported in carrier 1. The walls 10, 20, 30 and 40 also include curved portions 21 between straight portions 22 (see FIG. 5) between adjacent stems to conform to cans which are to be placed in carrier 1.

Figure 2:
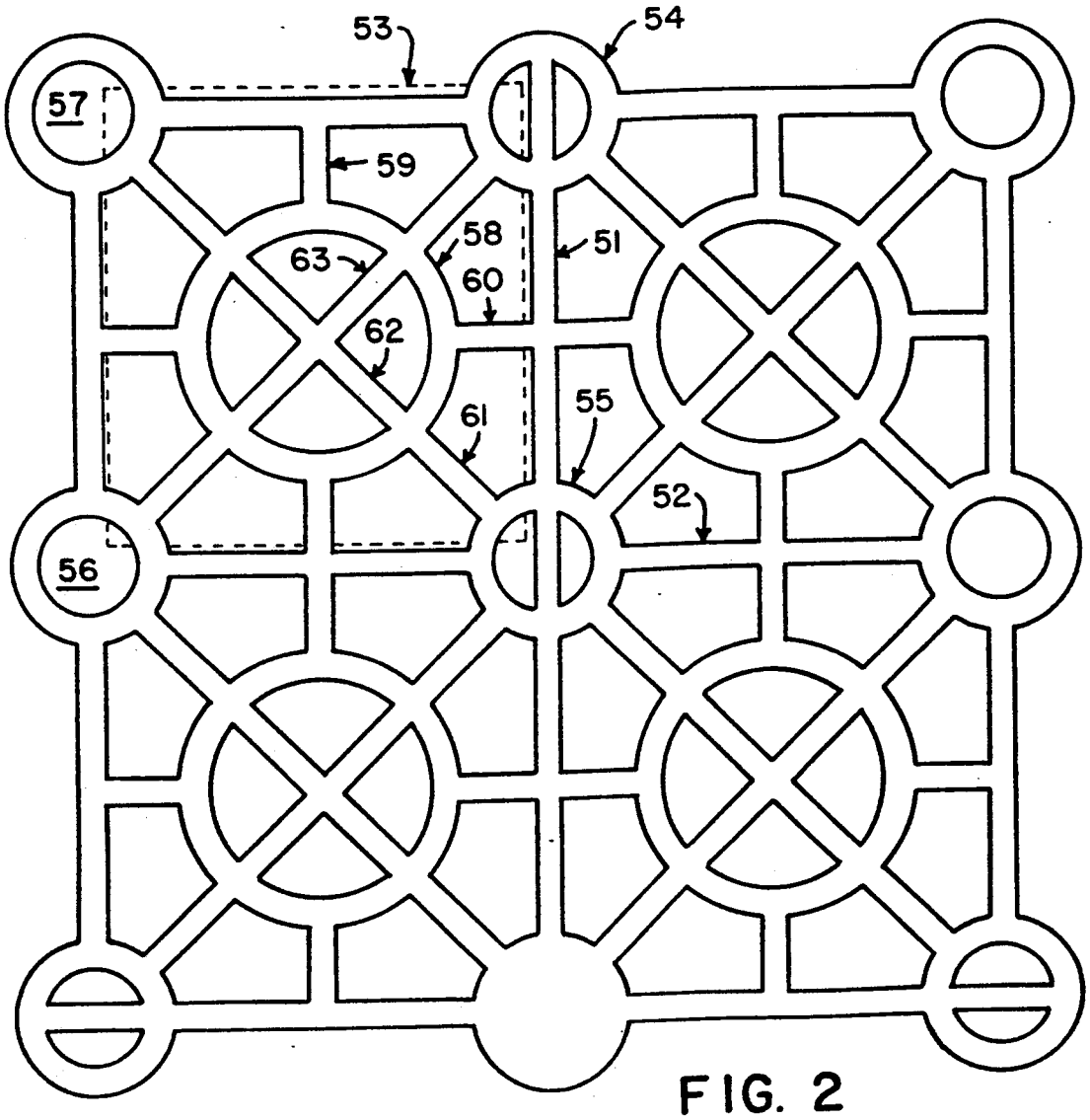
FIG. 2 is a plan view of part of the carrier base, showing particularly the relative position of the anti-doming feature.
Figure 3:
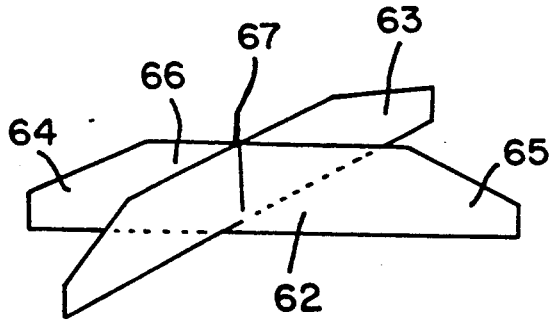
FIG. 3 is a perspective view of the anti-doming elements of the carrier.
Figure 4:
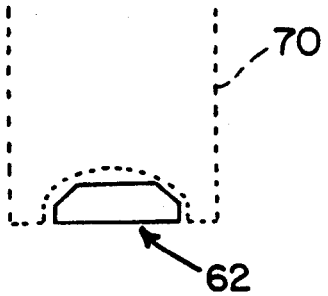
FIG. 4 is a cross sectional view of the anti-doming features resting underneath a can.

Base 50 of the carrier 1, as depicted in FIG. 2, generally comprises north/south ribs 51 and east/west ribs 52 defining rectangular areas 53. The transported containers 70 (see dashed outline in FIGS. 2 and 4) are centrally positioned on each rectangular area 53. Each area 53 has, in each of its four corners, circular "disks" 54, 55, 56 and 57 and an inner ring 58. Intermediate north-/south 59 and east/west ribs 60 are respectively perpendicular to east/west 53 and north/south ribs 51, extending from the center of the edge of each rectangle into inner ring 58. Diagonal ribs 61 extend from each corner of each area to inner circle 58.

Upwardly projecting segments 62 and 63 which perpendicularly bisect inner circle 58 along the lines of diagonal ribs 61 are contained in each inner circle 58. Each segment 62 and 63 has three zones which are rectangular zone 66 and tapered zones 64 and 65. The rectangular 66 and the tapered zones 64, 65 create an arc-like structure which fit underneath beverage containers such as cans to prevent doming of the cans' undersides. Preventing doming helps eliminate leaning of the cans, subsequent abrasions, additional denting or deformation of the domed can or the same with respect to its neighbors. Absence of the anti-doming feature could result in unsightly and unsaleable product and beverage loss.

Figure 7:
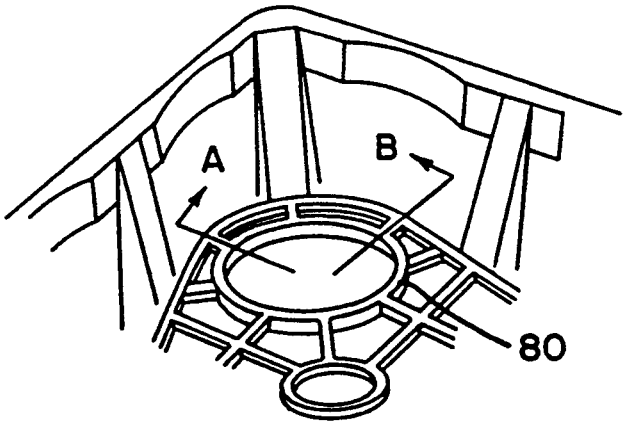
FIG. 7 is a perspective view of another embodiment of the carrier having an additional anti-leaning feature.
Figure 8:
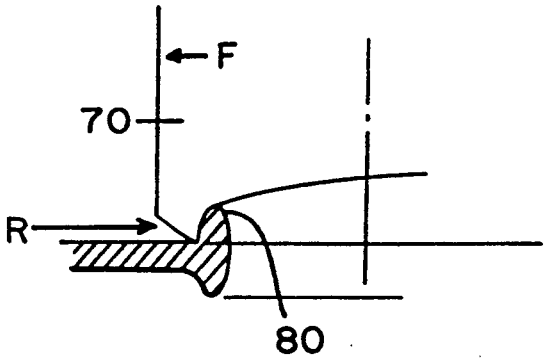
FIG. 8 is a cross-sectional view along cross sectional lines A and B of FIG. 7 depicting the anti-leaning feature against a beverage container.
Figure 9:
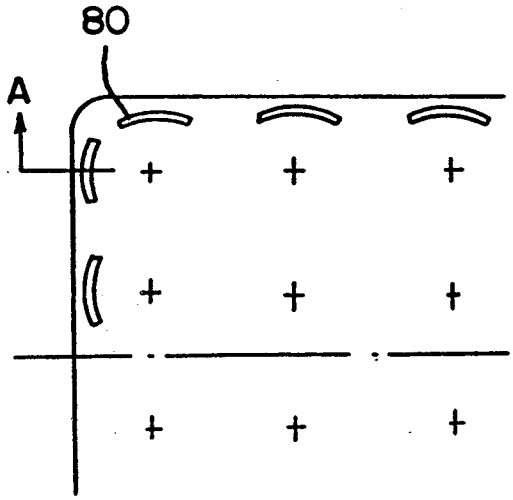
FIG. 9 is a plan view of the anti-leaning feature.

In another embodiment of the invention, as depicted in FIGS. 7-9, a half-moon structure 80 is built on carrier base 50 as a part of inner ring 58 to help prevent leaning of the beverage container in the carrier 1. The half moon 80 structure may be used independently of the anti-doming segments 62, 63 or in conjunction with them. When a delivery person attempts to remove the top carrier 1 from a stack of carriers, there is normally a tendency to tilt the container 70 (See FIG. 8) on the leading edge creating of force in the direction of force line F on the edge of the top of the cans in the next lower tray(s). That force is frequently sufficient to displace the can from the lower tray, particularly if the tray is a low depth type. The half moon 80 will prevent this occurrence by creating a reactive force in the direction of line R.

While the preferred embodiments of the invention have been illustrated in detail, modifications and adaptations to such embodiments will be apparent to those skilled in the art. However, it is to be expressly understood that such modifications and adaptations are within the spirit and scope of the present invention as set forth in the following claims:

I claim:

1. A carrier for supporting a plurality of deformable containers, comprising:

a base comprising a plurality of areas, wherein each of said areas supports one deformable beverage container and wherein each of said areas further comprises a plurality of disk members;

a plurality of side walls connected to said base along a substantial portion of the perimeter of said base, wherein each of said side walls comprises an upper rail and a plurality of ribs extending from said base to said upper rail; and an upwardly projecting member extending from each of said areas on said base, each said member comprising a central portion and peripheral portions, said peripheral portions being downwardly tapered to conform to the shape of the bottom surface of a container supported on said carrier thereby preventing the container from deforming.

2. The carrier of claim 1, further comprising a second upwardly projecting member extending from each of a plurality of said areas, said second members intersecting said first members.

3. The carrier of claim 2 wherein each of said second members is substantially perpendicular to each of said first members.

4. The carrier of claim 3 wherein each of said areas comprises an inner ring, said first and second members positioned within each of said inner rings.

5. The carrier of claim 3, wherein said base further comprises reinforcing ribs.

6. The carrier of claim 4, further comprising at least one rib extending from one of said disk members to said inner ring.

7. The carrier of claim 1 wherein said carrier is a beverage container carrier.

* * * * *